US008833218B2

(12) United States Patent
Tiita et al.

(10) Patent No.: US 8,833,218 B2
(45) Date of Patent: Sep. 16, 2014

(54) METHOD IN TURN-UP OF REELING OF FIBER WEBS AND A TURN-UP DEVICE FOR A REEL-UP OF FIBER WEBS

(75) Inventors: Jari Tiita, Kellokoski (FI); Teppo Kojo, Mäntsälä (FI); Pentti Simpanen, Halkia (FI); Aki Tuominen, Vantaa (FI)

(73) Assignee: Valmet Technologies, Inc., Espoo (FI)

( * ) Notice: Subject to any disclaimer, the term of this patent is extended or adjusted under 35 U.S.C. 154(b) by 229 days.

(21) Appl. No.: 13/434,609

(22) Filed: Mar. 29, 2012

(65) Prior Publication Data

US 2013/0075520 A1 Mar. 28, 2013

(30) Foreign Application Priority Data

Apr. 1, 2011 (EP) ..... 11160819

(51) Int. Cl.
*B26F 3/00* (2006.01)

(52) U.S. Cl.
USPC ..... 83/177; 83/614

(58) Field of Classification Search
USPC ..... 83/177, 614
See application file for complete search history.

(56) References Cited

U.S. PATENT DOCUMENTS

| | | | | |
|---|---|---|---|---|
| 3,365,992 | A * | 1/1968 | Dreher | 83/614 |
| 4,182,170 | A * | 1/1980 | Grupp | 83/177 |
| 4,444,362 | A * | 4/1984 | Karr | 242/526.3 |
| 4,445,646 | A * | 5/1984 | Karr et al. | 242/521 |
| 4,695,004 | A | 9/1987 | Grossmann et al. | |
| 5,360,179 | A | 11/1994 | Vesterinen et al. | |
| 5,762,759 | A * | 6/1998 | Wedel | 162/193 |
| 6,135,000 | A | 10/2000 | Caspar et al. | |
| 6,364,240 | B1 | 4/2002 | Madrzak et al. | |
| 2011/0083795 | A1 | 4/2011 | Kowalewski et al. | |

FOREIGN PATENT DOCUMENTS

| | | | |
|---|---|---|---|
| CN | 101970322 | A | 2/2011 |
| DE | 10338781 | A1 | 3/2005 |
| DE | 102008009958 | | 5/2009 |
| EP | 1035053 | A2 | 9/2000 |
| EP | 1035056 | A2 | 9/2000 |
| EP | 1035053 | B1 | 7/2004 |
| EP | 20110160819 | | 4/2011 |
| FI | 120445 | B1 | 10/2009 |
| WO | 2008125723 | A1 | 10/2008 |

OTHER PUBLICATIONS

European Search Report for EP11160819 dated Oct. 17, 2011.
Search Report for Chinese Patent Application for Invention from Finland No. 201210101760.2.

* cited by examiner

*Primary Examiner* — Sang Kim
(74) *Attorney, Agent, or Firm* — Stiennon & Stiennon

(57) ABSTRACT

A fiber web is reeled by a reeling drum of a reel-up onto a parent roll. When the parent roll has reached the desired diameter size, reeling is changed from the parent roll onto a new parent roll. The web is cut by jet cutting means and the beginning part of the cut web is directed onto a reeling shaft of a new parent roll. The jet cutting path has a main cutting path and at least one edge area cutting path. The length of the main cutting path is at least 60% of the whole cutting path length from one edge of the web (W) to the other edge of the web (W). A turn-up device for a reel-up has one cutting module (15) and at least one nozzle (11) for jet cutting, which is attached movably and turnably to the module (15) by a cutting arm (12).

11 Claims, 4 Drawing Sheets

METHOD IN TURN-UP OF REELING OF FIBER WEBS AND A TURN-UP DEVICE FOR A REEL-UP OF FIBER WEBS

CROSS REFERENCES TO RELATED APPLICATIONS

This application claims priority on App. No. EP 11160819, filed Apr. 1, 2011, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to reeling of fiber webs in a fiber web machine. More especially the present invention relates to a method in a turn-up device of reeling the web with a reeling drum of the reel-up onto a parent roll, in which, when the parent roll has reached the desired diameter size, reeling is changed from the parent roll onto a new parent roll by cutting the web by a jet cutting means and the beginning part of the cut web is directed onto a reeling shaft of a new parent roll.

As known from the prior art, fiber web producing processes typically comprise an assembly formed by a number of apparatuses arranged consecutively in the process line. A typical production and treatment line comprises a head box, a wire section and a press section as well as a subsequent drying section and a reel-up. The production and treatment line can further comprise finishing devices, for example a calender and/or a coater. The production and treatment line also comprises typically at least one slitter-winder for forming customer rolls as well as a roll packaging apparatus.

The reel-up is a device which reels a material produced as a continuous fibrous web into the reel form as a machine reel. In the production process of the fiber web, reeling-up is usually the first sub-process in which continuous production is interrupted to continue in sequences. A machine reel is formed around a reel spool operating as the reeling core i.e. the fibrous web being on one machine reel has a start and an end. The trend in the field is a continuous increase in the size of machine reels, which causes an on-going development requirement for reel-ups. The dimensioning of the reel spool specifies the maximum size of the machine reel in practice. However, as we are concerned with a dynamic environment and the fiber web is reel-able material sensitive to various faults, the task performed by the reel-up as the maintainer of the efficiency of the paper or board machine is very considerable. A reason behind the continuous increase in the size of machine reels is the desire to obtain fewer starts and ends in the production of the fibrous web, which impede or disturb the production and decrease the efficiency.

In the reel-up of a continuously operating fiber web machine or a finishing part, for example a coating part, or equivalent, when the parent (machine) roll to be reeled becomes full or reaches the desired size, the fiber web is changed from the full roll onto a reeling shaft for beginning of reeling of a new parent roll typically at full running speed of the machine. In such a case from the cutting-off of the fiber web and from its change onto the new reeling shaft for beginning of reeling of the new parent roll, reliability of operation is required in order that the operation does not have to be interrupted.

It is well-known from prior art to use a water jet to cut the fibrous web by a special device. The device according to U.S. Pat. No. 6,135,000 which is incorporated by reference herein, comprises at least one, preferably two carriages, which are moved on a guide bar and which comprise nozzles that move along with the carriage for shooting the water jet(s) to cut the moving fibrous web. In addition to the moving nozzles, the device also comprises moving hose wheels, the purpose of which is to keep the high-pressure hoses, which lead to the nozzles, directly conveyed during the fast movement of the carriage. The longitudinal feed of the hose is synchronously connected to the movement of the carriage and the feed can be controlled both during the cutting and the return movement.

In U.S. Pat. No. 5,360,179, which is incorporated by reference herein shows a method and a device for reeling a web, i.e., a turn-up. A device is described wherein the web is reeled by a reeling drum onto a parent roll, whereby when the parent roll has reached the desired diameter size, new reeling is started from the parent roll of desired size onto a new parent roll. After the parent roll has reached the desired diameter size, a tip part is cut into the web by means of a water jet or water jets and the tip part is blown into contact with a reeling shaft of the new parent roll, whereupon the web is cut off by means of the water jet or water jets. In this prior art arrangement the publication describes a means with two water jets used in cutting a web, and references cutting with one water jet but not actual means are taught. The cutting path with one water jet shown in FIG. 2C is in many cases impossible or at least very difficult in practice since there is no room for the nozzle movement all the way from one edge to another edge due to different components of the reel-up located at the sides. Thus the areas near the edge cannot be cut by the water jets and the web tears uncontrollably and increases the risk of web break or other disturbances. The arrangement with two nozzles as shown in FIG. 1 and the cutting paths shown in FIGS. 2A-2B require two sets of equipment including for example two slides, two motors and two cutting modules, one for each nozzle and cutting path. In these prior art arrangements the linear module has a restricted length due to other components of the reel-up for example due to the space needed for reel spool storage lowering arms and thus the cut does not reach the edges of the web without complicated special arrangements. One disadvantage of these prior art arrangements is that the cutting pressure for the nozzle(s) is raised to the right cutting level only after the nozzle(s) has moved and been on the web already some time and the waiting time for the right pressure level causes broke. This is critical especially when cutting thicker fiber webs, e.g., board, since there the waiting time is longer since it is critical that the cutting pressure is correct when the cutting is begun otherwise the web is not cut or it tears uncontrollably.

In Fl patent 120445 is described an arrangement for a water jet turn-up device in which the beam for a nozzle(s) is movable and/or turnable from a cutting position to maintenance position for changing the nozzles of the water jet turn-up device and for other maintenance actions to the device.

If a nozzle of a water jet turn-up device is not functioning it has to be changed and the web has to be cut manually and the reel-up has to be stopped at least partially for the change of the nozzles. As this causes a break in production it needs to be done as fast as possible to minimize the break time.

SUMMARY OF THE INVENTION

A non-mandatory object of the present invention is to create a new improved method in turn-up reeling of fiber webs and a turn-up device for a reel-up of fiber webs in which possible disadvantages and problems of known methods and devices are eliminated or at least minimized.

One object of the present invention is to solve at least part of the disadvantages and problems relating to methods and devices according to the prior art.

The device according to the invention comprises one cutting module and at least one nozzle for jet cutting.

In this description and in the claims by the term "jet cutting" is meant such cutting means that accomplish the cutting of the fiber web by a jet, in particular a water jet cutting. It is to be understood that jet cutting also covers applications of laser cutting and cutting by liquid jet with other liquid than water and cutting by jet of a gaseous substance, and combinations of those.

In the method according to the invention the cutting path comprises a main cutting path and an edge area cutting path. In the method at least 60% and advantageously at least 75% of the cutting path length is covered by the main cutting path. Advantageously the main cutting path is cut by one nozzle followed by turning the nozzle around a pivot point such that the edge area cutting path deviates from the main cutting path. The edge area cutting is advantageously in the end of the cutting path.

In this description and in the claims the term "by the edge area" means the area in transverse direction of the web near an edge of the web. The length of the edge area cut, i.e. the cut in area near the edge, is typically less than 25% of the transverse length of the web i.e. the width of the web.

According to an advantageous embodiment of the invention the device comprises one nozzle and the edge cutting is done by turning the nozzle to accomplish a cutting movement deviating from the substantially linear main cutting movement. The device comprises according to a preferred feature a pivot point such as a turning joint and mechanical lever mechanism by which when the nozzle reaches the unlocking point for the turning joint, turning of the cutting arm is provided for. For example the turning joint may incorporate a torsion spring so that when the slide reaches a stop e.g., at the end of the beam on which the slide is mounted, the turning joint is released by a lever to be rotated by the torsion spring, providing the cutting movement which deviates from the substantially linear main cutting movement.

According to another embodiment of the invention in which the turn-up device has two nozzles, the main cutting path is cut by one water jet from one nozzle and the edge cutting path is cut by another water jet from another nozzle.

According to a further advantageous feature of the invention, the device has one full width linear module that provides for full width cutting of the web from one edge to the other edge. One or two nozzles are attached by cutting arm(s) to a slide attached transferably to the module. The cutting arm(s) provide for transferring the nozzle(s) outside the web edge. If two nozzles are used the cutting arms consist of a T-shaped arm construction such that only one water channel from a water source is needed. The cutting arms in two nozzle construction are advantageously of different length such that in a cutting situation the nozzle that is first in the direction of cutting is closer to the module than the one coming behind, thus making the web slice in between the cuts narrower.

According to another feature in the embodiment of two cutting nozzles the device is advantageously provided with a control system for controlling the cutting of each nozzle and for arranging a delay in cutting with the second nozzle for achieving crossing cutting paths in order to minimize the amount of broke.

According to another advantageous feature, the device has a turning mechanism for changing out the nozzle(s) or for performing maintenance on a nozzle by having the nozzle rotate on an arm to a position off the web. By these turning means the nozzle is turned to the side of the reel-up into a position where it is easily reachable outside of the woven support fabric and the fiber web area for maintenance. In the embodiment of two nozzles, advantageously each nozzle is turned at different sides of the reel up and the nozzle change can be done during production which leads to better efficiency.

The present invention provides for the possibility to raise the pressure level to correct cutting pressure outside the web area and thus the cutting is possible to start right at the edge and this eliminates or at least minimizes the broke amount.

In the following the invention is discussed in more detail by reference to the figures of the accompanying drawings.

DESCRIPTION OF THE PREFERRED EMBODIMENTS

In the following description the same reference signs designate similar components unless otherwise mentioned and it should be understood that the examples are susceptible of modification in order to adapt to different usages and conditions within the frames of the invention.

Figure 1:
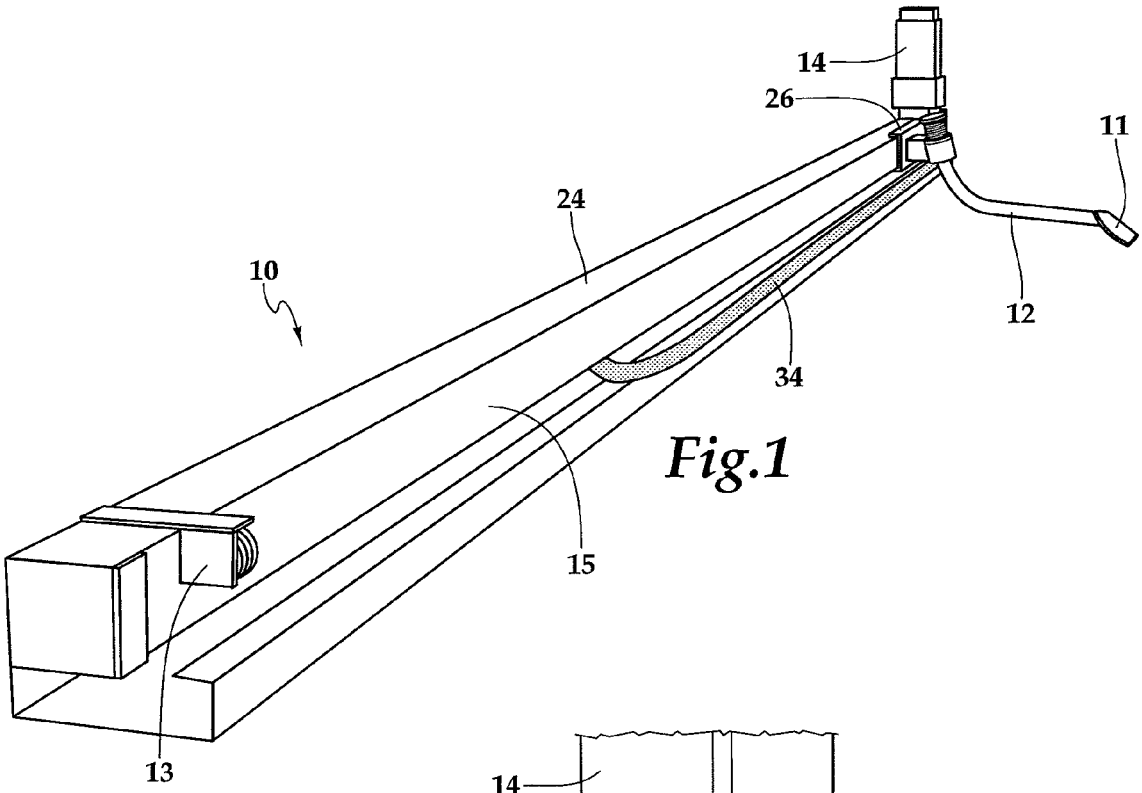
FIG. 1 shows schematically one example of one embodiment of a device according to the invention.
Figure 2:
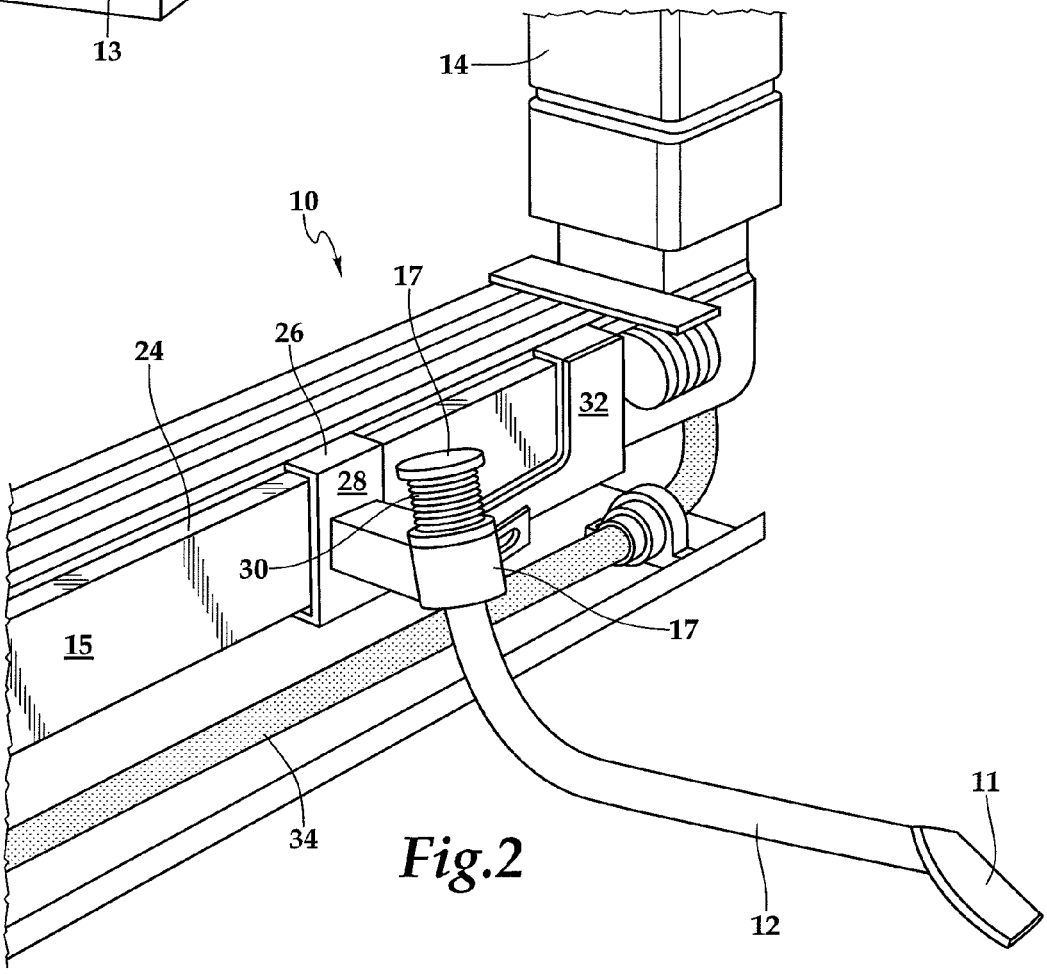
FIG. 2 shows schematically an enlarged partial image of FIG. 1.

In the example of FIGS. 1-2 the turn-up device for a reel-up of a fiber web machine comprises a linear module 15, having a liner beam 24 and a slide 26 which rides on the beam together with a motor 14 which drives a timing belt (not shown) which moves the slide linearly along the beam. One water jet nozzle 11 is attached to a cutting arm 12. The other end of the cutting arm 12 is movably attached to the surface 28 of the slide 26 of the linear module 15 by a turning joint 17. The turning joint 17 incorporates a torsion spring 30 which provides the force to rotate the arm 12. In this example stoppers 13 attached at each end of the linear module spaced from the end limit the main cutting movement and give the mechanical impulse for unlocking the arm 12 so the torsion spring 30 provides the edge area movement and turning of the cutting arm 12 with the nozzle 11 around the turning joint 17.

Figure 3:
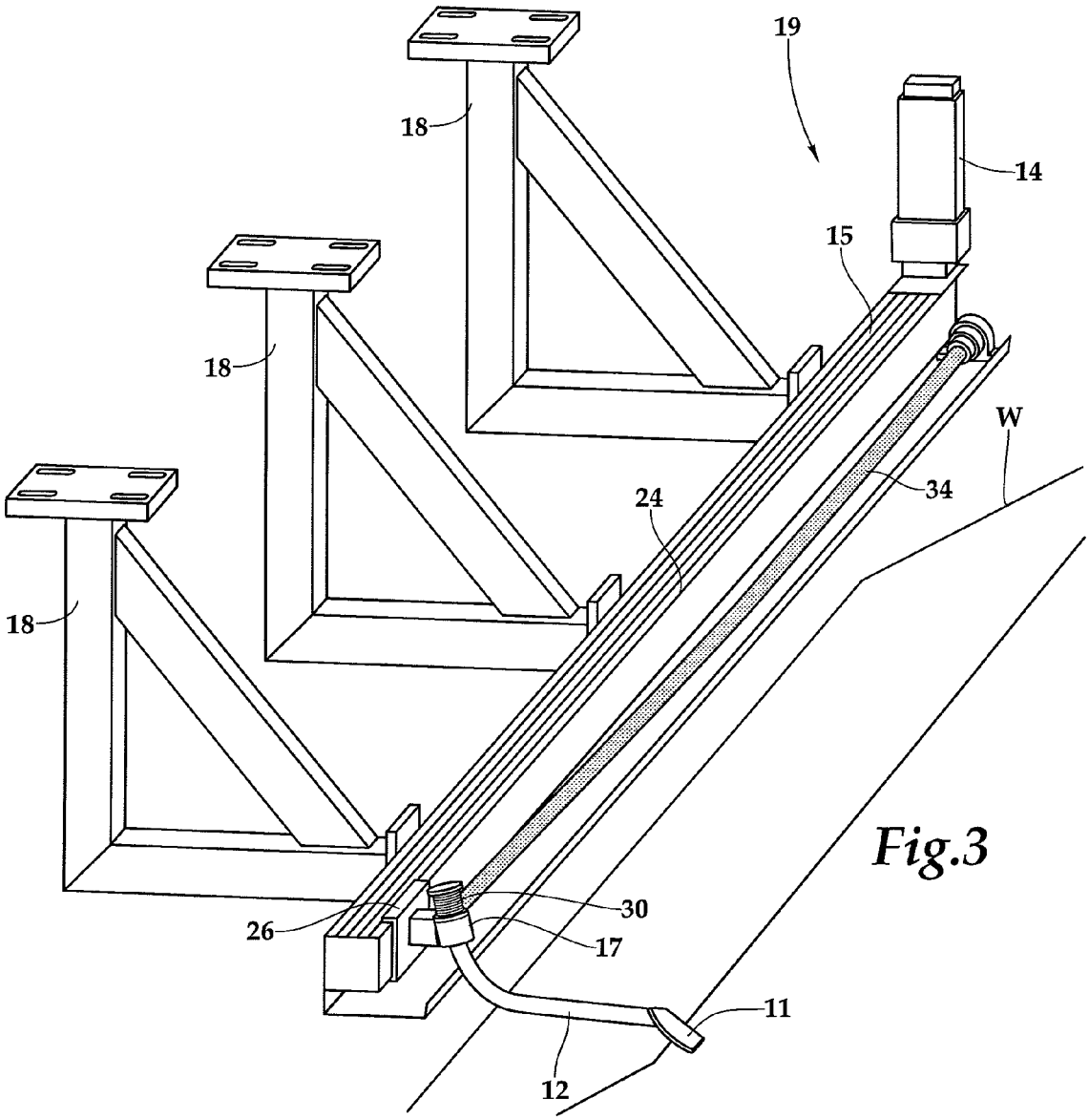
FIG. 3 shows schematically one example arrangement for mounting an example of one embodiment of a device according to the invention.

As shown in the example of FIG. 3, a device 10 is attached to a frame of a reel-up by frame parts 18 that support the device 10 and are attached to the linear module 15. The web W to be cut is located below the device 10 and the cutting movement of the cutting arm 12 with the nozzle 11 is arranged to cover the whole width of the web by combination of the main cutting movement and the edge cutting movement(s).

Figure 5:
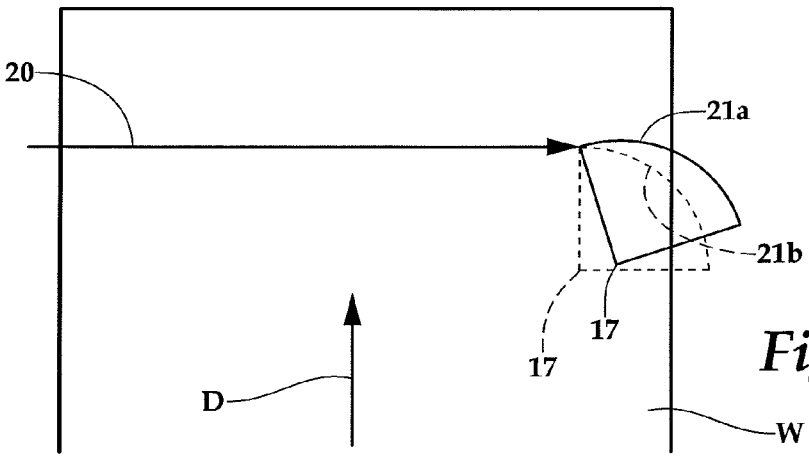
FIG. 5 shows schematically some possibilities for cutting paths of one embodiment of the invention.
Figure 4:
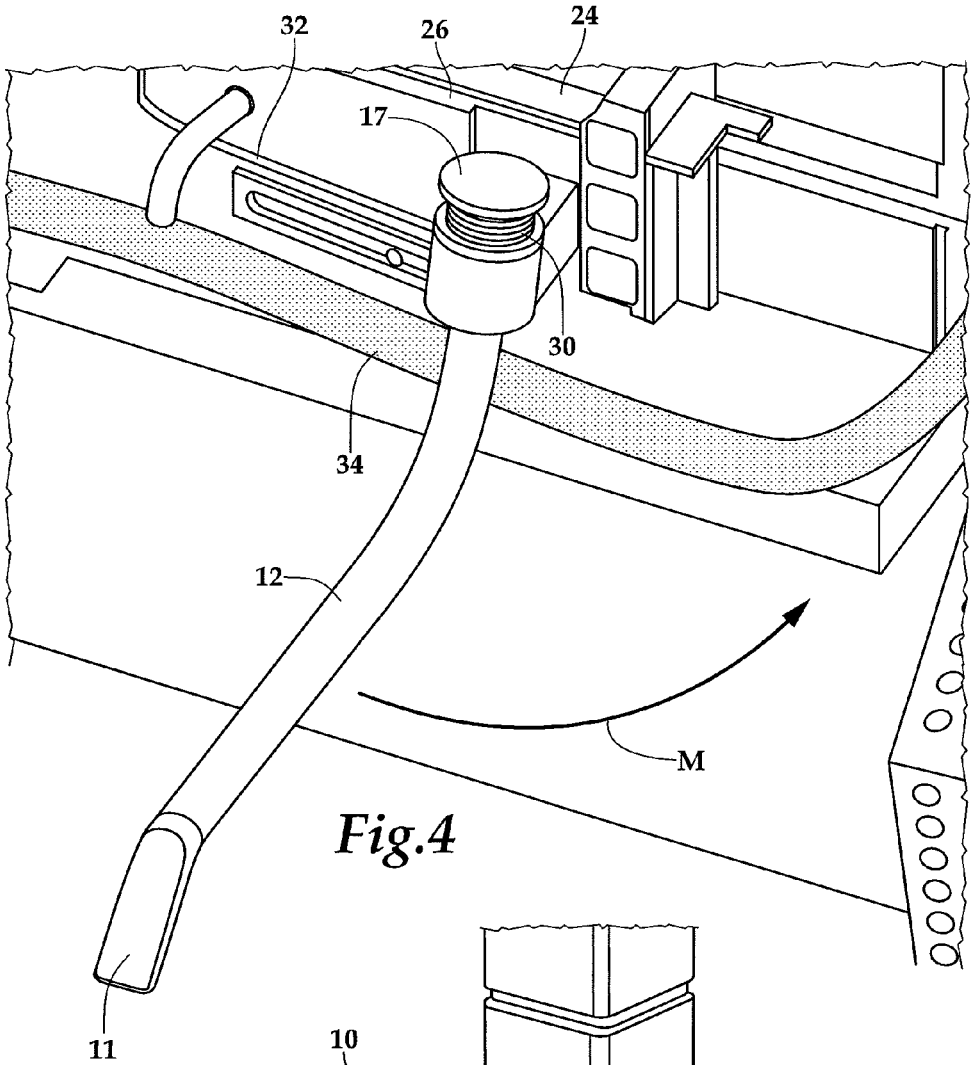
FIG. 4 shows schematically an example for changing a nozzle of a device according to an embodiment of the invention.

As shown in FIGS. 4 and 5, the device 10 has one nozzle 11 used to form the edge cutting path 21*a*, 21*b* by turning the cutting arm 12 to accomplish a cutting movement deviating from the substantially linear main cutting path 20. The module 15 comprises, according to a preferred feature, a turning joint 17 and a mechanical lever mechanism 32 which interacts with a stopper 13. When the slide 26 and the cutting arm 12 reach the stopper 13, the cutting arm is unlocked by a lever mechanism 32 so the torsion spring 30 turns the arm 12 about the turning joint 17, providing for the turning movement of the nozzle 11 shown in FIG. 5.

Figure 6:
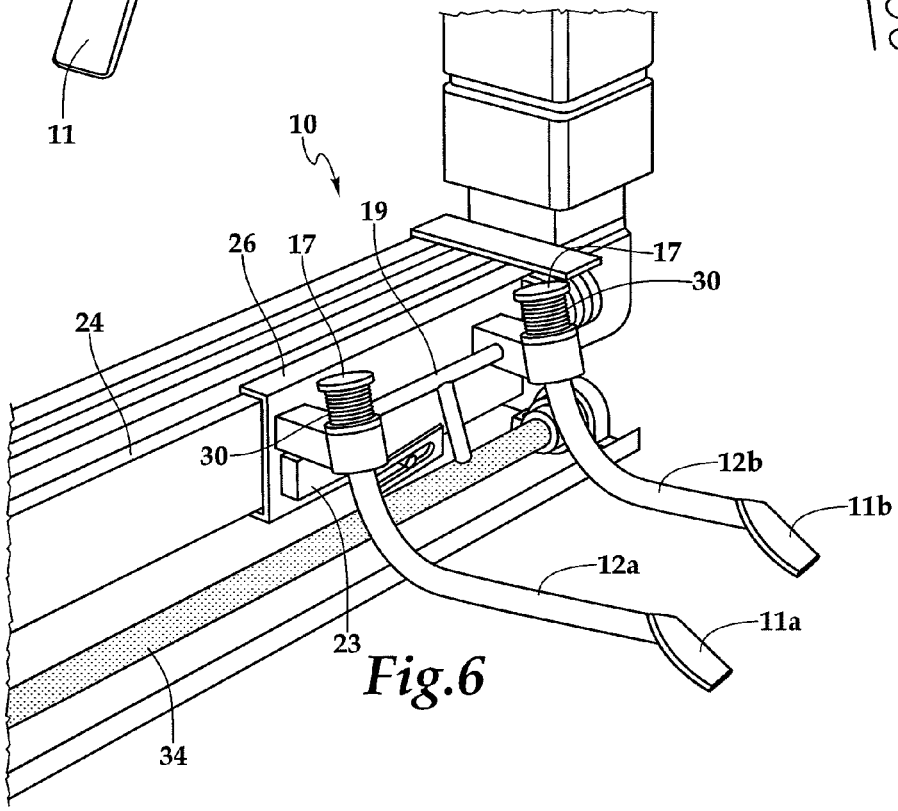
FIG. 6 shows another embodiment of a device according to the invention.

In FIG. 4 is shown one example of movement of the nozzle 11 to the change and maintenance position of the cutting arm 12. In the figure the nozzle 11 and the cutting arm 12 are in a cutting position but the cutting arm 12 with the nozzle 11 is turnable around the turning joint 17 to the change to the maintenance position on the side of the device as shown by movement path M. In the embodiment of FIG. 6 with two nozzles advantageously each nozzle is turned at different sides of the reel up.

As shown in FIG. 5 the cutting path of the water jet for cutting the web comprises the main cutting path 20 formed by the main cutting movement of the cutting arm 12 and the nozzle 11 in the embodiment of the invention in which one nozzle is used. The main cutting path 20 covers at least 60%, advantageously at least 75% of the width of the web. The edge cutting path 21*a* or 21*b* are formed by turning the cutting arm 12 with the nozzle 11 around the turning joint 17, seen as a pivot point in FIG. 5. Several different forms for the edge cutting path 21*a*, 21*b* are possible, depending on the speed of the web, the speed of the turning movement, and the orientation of the arm, e.g., it is perpendicular to the cutting path 20 at the start of cutting path 21*b* and is angled against the direction of travel at the start of cutting path 21*a*.

In FIG. 6 is a presentation of one embodiment of the invention in which two nozzles 11*a*, 11*b* are used instead of one nozzle 11, and each nozzle has its own cutting arm 12*a*, 12*b* that advantageously unite to a T-form 19 so that only one attachment to the linear module 15, and the high pressure hose 34 is needed. In this embodiment the main cutting path is done by one nozzle e.g., nozzle 11*b* and the edge cutting path is done by the other nozzle e.g., 11*a* for example as shown in the examples of FIGS. 7 and 8.

Figure 7:
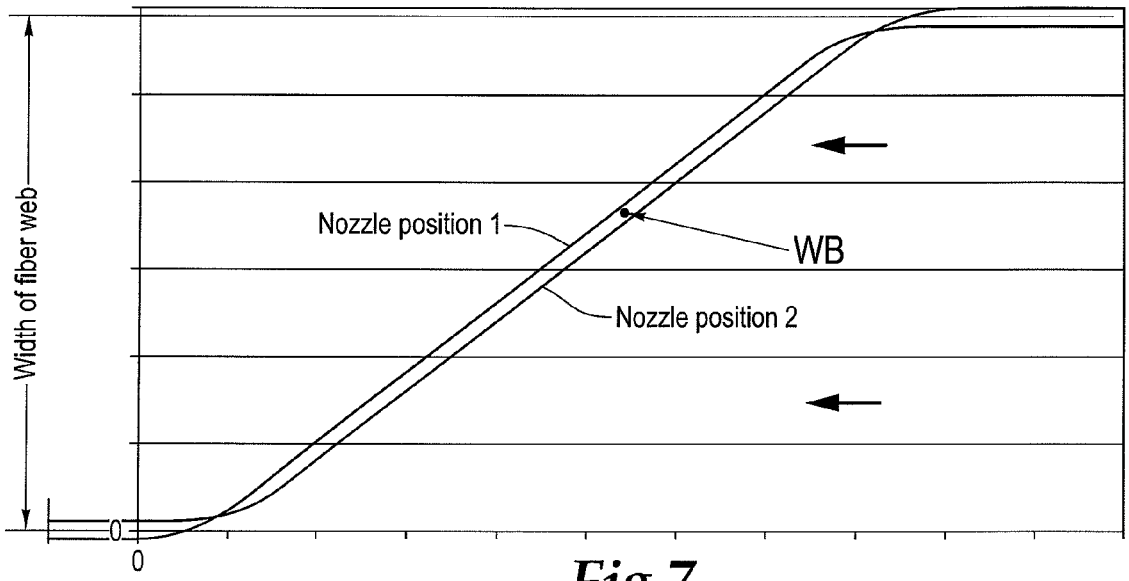
FIG. 7 shows schematically some possibilities for cutting paths of one embodiment of the invention.
Figure 8:
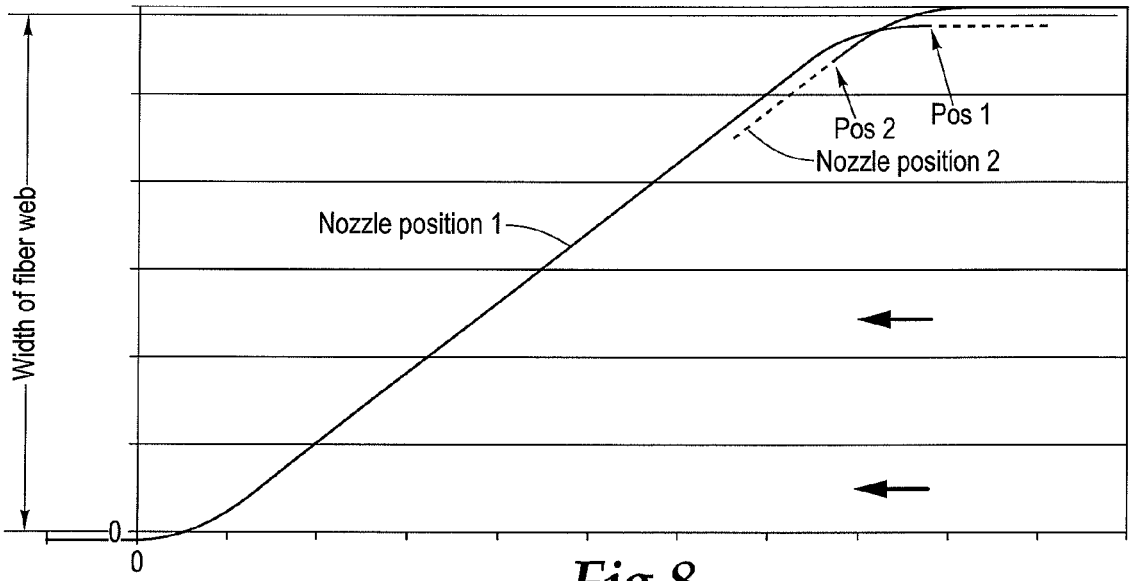
FIG. 8 shows schematically some possibilities for cutting paths of one embodiment of the invention.

In FIGS. 7 and 8 are schematic examples of the cutting movements. In the example of FIG. 7 the web is cut by using both nozzles 11*a* and 11*b* and a slice web WB is formed in-between the cuts. In the example of FIG. 8 each nozzle 11*a*, 11*b* has its own control valve and thus one of the cuts can be limited to the edge area only. As shown in the previous figures, the water jet turn-up device 10 comprises one cutting module 15, advantageously a linear module, and at least one nozzle 11, 11*a*, 11*b*. In the method the cutting path comprises a main cutting movement 20 and an edge area cutting movement 21*a*, 21*b*. In the method over 50%, advantageously at least 60%, and more advantageously over 75%, of the cutting path is cut by one nozzle 11, 11*a*, 11*b* and the edge area cutting is advantageously in the end of the cutting path.

According to further advantageous features the device 10 has one full width linear module 15 as best shown in FIGS. 1 and 3 that provides for full width cutting of the web W from one edge to the other edge. One nozzle 11 is attached by the cutting arm 12 or there are two nozzles 11*a*, 11*b* which are attached by cutting arms 12*a*, 12*b* to a slide 26 and arranged attached to, and transferrable on beam 24 of the module 15. The cutting arm(s) 12, 12*a*, 12*b* provide for transferring the nozzle(s) 11, 11*a*, 11*b* outside the web edge. If two nozzles are used the cutting arms have a T-shaped arm construction 19 such that only one water channel, pipe, or hose from the water source is needed. The cutting arms 12*a*, 12*b* may each be mounted to the slide 26 (as shown) or to a single T-shaped structure incorporating the water channel 19. The cutting arms in the two nozzle construction are advantageously of different length such that in a cutting situation the first nozzle is closer to the module than the one coming behind, thus making the web slice in between the cuts narrower.

In the embodiment of two cutting nozzles, the device is advantageously provided with a control system 23 for controlling the cutting of each nozzle and for arranging a delay in cutting with the second nozzle for achieving crossing cutting paths in order to minimize the amount of broke, as shown in FIG. 8.

Above some preferred embodiments and examples of the invention have been described but many modifications are possible to those presented.

We claim:

1. A turn-up device for a reel-up of fiber webs, comprising:

a cutting module having a linear beam and a slide mounted for linear motion in a cross-direction along the beam over a selected linear distance;

an arm attached to the slide about a pivot point, so that the arm is fixable in a position to extend away from the slide and the linear beam, and is pivotable on the pivot point to another position closer to the linear beam or an imaginary extension of the beam so the arm extends in the cross-direction beyond the selected linear distance;

at least one nozzle for jet cutting mounted on the arm spaced from the slide to move linearly with the slide when the arm is fixed so as to cut along a linear path spaced from and parallel to the beam; and wherein the at least one nozzle on the arm is arranged to extend beyond, in the cross-direction, the selected linear distance and to cut when pivoted on the pivot point along a circular path beginning or terminating beyond the selected linear distance.

2. The device of claim 1 further comprising a mechanical lever mechanism by which the at least one nozzle is unlocked allowing the arm to turn around the pivot point so the at least one nozzle moves along the circular path.

3. The device of claim 1 wherein the cutting module is mounted to the turn-up device so that the linear beam is mounted in a direction transverse of a fiber web, and the slide and at least one nozzle is movable in the same transverse direction over the fiber web.

4. The device of claim 1 wherein two nozzles are attached by two cutting arms to the slide.

5. The device of claim 4 wherein the cutting arms are arranged as a T-shaped arm construction which receives water from only one water channel from a cutting jet water source.

6. The device of claim 4 wherein the two nozzles for jet cutting are provided with a control system for controlling the cutting of each of the two nozzles.

7. A turn-up device for a reel-up of fiber webs, comprising:

a cutting module having a linear beam and a slide mounted for linear motion on the beam; and at least one nozzle for jet cutting which is attached to the slide by an arm to move linearly with the slide and wherein the arm is mounted to pivot on the slide so the at least one nozzle travels along a circular path with respect to the slide;

wherein the cutting arms are arranged as a T-shaped arm construction which receives water from only one water channel from a cutting jet water source;

wherein the cutting arms are of different length such that in a cutting position the first nozzle is closer to the cutting module than the one coming behind, thus making the web slice in between the cuts narrower.

8. A device for cutting fiber webs along a linear path, and along a circular path, comprising:

a beam arranged to extend in a direction transverse to a fiber web;

a slide mounted for linear transverse positioning on the beam, and for linear transverse motion on the beam to move over and in the direction transverse to the fiber web;

at least one nozzle for jet cutting which is attached about a turning joint to the slide by an arm, the arm defining a length which spaces the at least one nozzle from the turning joint such that when the at least one nozzle is fixed with respect to the slide the nozzle moves and cuts the fiber web linearly in the direction transverse to the web; and wherein the arm is pivotable about the turning joint so that the nozzle cuts along a circular path defined by the turning joint and the arm length, and wherein the length of the arm is such that the nozzle when pivoted about the turning joint is arranged to extend, in the direction transverse to the web, beyond the web.

9. The device of claim 8 further comprising:

a torsion spring arranged to pivot the arm on the turning joint;

a fixedly mounted stop; and a mechanical lever mechanism by which the arm is unlocked to pivot about the turning joint when the mechanical lever mechanism engages the stop.

10. The device of claim 8 further comprising a second nozzle for jet cutting which is attached about a second turning joint to the slide by a second arm, the second arm spacing the second nozzle from the second turning joint such that when the second nozzle is fixed with respect to the slide the second nozzle moves and cuts the fiber web linearly in the direction transverse to the web.

11. The device of claim 10 wherein the cutting arms are arranged as a T-shaped arm construction which receives water from only one water channel from a cutting jet water source.

* * * * *